US011236892B2

(12) United States Patent
Sharrah et al.

(10) Patent No.: US 11,236,892 B2
(45) Date of Patent: Feb. 1, 2022

(54) CLAMPING LIGHT WITH ROTATABLE LIGHT HEAD

(71) Applicant: Streamlight, Inc., Eagleville, PA (US)

(72) Inventors: Raymond L. Sharrah, Collegeville, PA (US); Cleatis Eichelberger, East Norriton, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 16/918,346

(22) Filed: Jul. 1, 2020

(65) Prior Publication Data

US 2022/0003394 A1 Jan. 6, 2022

(51) Int. Cl.

| | |
|---|---|
| ***F21V 21/088*** | (2006.01) |
| ***F21V 21/14*** | (2006.01) |
| ***F21V 21/096*** | (2006.01) |
| ***F21V 21/26*** | (2006.01) |
| ***F21L 4/04*** | (2006.01) |
| ***F21V 23/06*** | (2006.01) |
| ***F21V 29/83*** | (2015.01) |

(52) U.S. Cl.

CPC ..... *F21V 21/0885* (2013.01); *F21L 4/04* (2013.01); *F21V 21/0965* (2013.01); *F21V 21/145* (2013.01); *F21V 21/26* (2013.01); *F21V 23/06* (2013.01); *F21V 29/83* (2015.01)

(58) Field of Classification Search

CPC ..... F21V 21/145; F21V 21/26; F21V 21/30; F21V 21/24; F21L 4/04; F16M 11/24; F16M 11/10

See application file for complete search history.

(56) References Cited

U.S. PATENT DOCUMENTS

| | | | | |
|---|---|---|---|---|
| 3,696,239 | A * | 10/1972 | Duddy | F21V 21/145 362/275 |
| 4,849,864 | A * | 7/1989 | Forrest | F21S 8/00 362/225 |
| 8,142,045 | B2 * | 3/2012 | Peak | F21V 21/06 362/191 |
| 2005/0117333 | A1 * | 6/2005 | Yoshida | F21V 21/30 362/147 |
| 2012/0033412 | A1 * | 2/2012 | Molina | F21V 21/088 362/119 |
| 2013/0182424 | A1 * | 7/2013 | Staeubli | F21V 29/75 362/191 |
| 2015/0267902 | A1 * | 9/2015 | Zhang | F21L 4/04 362/188 |
| 2017/0299161 | A1 * | 10/2017 | Boorom | F21V 29/508 |
| 2017/0314769 | A1 * | 11/2017 | Cacciabeve | B60Q 3/35 |

(Continued)

FOREIGN PATENT DOCUMENTS

| | | |
|---|---|---|
| EP | 3081844 B1 | 10/2019 |
| EP | 3715701 A1 | 9/2020 |

OTHER PUBLICATIONS

Husky 1500-Lumens Rechargeable Clamp LED Work Light; {Retrieved from the internet: https://www.homedepot.com/p/Husky-1500-Lumens-Rechargeable-Clamp-LED-Work-Light-CL1500HD/309828851}; retrieved on Jun. 27, 2020.

*Primary Examiner* — William N Harris

(74) *Attorney, Agent, or Firm* — Quarles & Brady LLP; James J. Aquilina

(57) ABSTRACT

A portable lighting device capable of being clamped on a multitude of structures is disclosed. In some embodiments, the portable lighting device includes a rotatably adjustable light head.

20 Claims, 10 Drawing Sheets

(56) References Cited

U.S. PATENT DOCUMENTS

| | | | | |
|---|---|---|---|---|
| 2018/0224101 | A1* | 8/2018 | Qiu | F21V 21/28 |
| 2019/0309930 | A1* | 10/2019 | Ernst | F21V 17/06 |
| 2020/0309355 | A1* | 10/2020 | Cacciabeve | F21L 4/045 |
| 2021/0254817 | A1* | 8/2021 | Dyson | F21S 6/006 |
| 2021/0325009 | A1* | 10/2021 | Dyson | F21V 14/02 |

* cited by examiner

CLAMPING LIGHT WITH ROTATABLE LIGHT HEAD

FIELD OF THE DISCLOSURE

The present disclosure relates to the field of portable lighting devices, and more particularly to a portable lighting device that can be clamped on various structures.

BACKGROUND

Portable lights having variable light output intensity and positional adjustability are known in the art. Some of these portable lights have an adjustable light head to vary the direction of light emitted by the device. Many of these devices are limited in the way that they can be positioned or mounted to interact with the environment in which the light is being used, thus limiting their usability. Many of these devices are also not collapsible into a low-profile configuration for storability when not in use.

Accordingly, there is a need for improved portable lighting devices that overcome these and other drawbacks of the prior art devices.

BRIEF DESCRIPTION OF THE DRAWINGS

The lighting device according to the present disclosure is further described with reference to the accompanying drawings, in which.

SUMMARY OF THE INVENTIVE CONCEPTS

Figure 1:
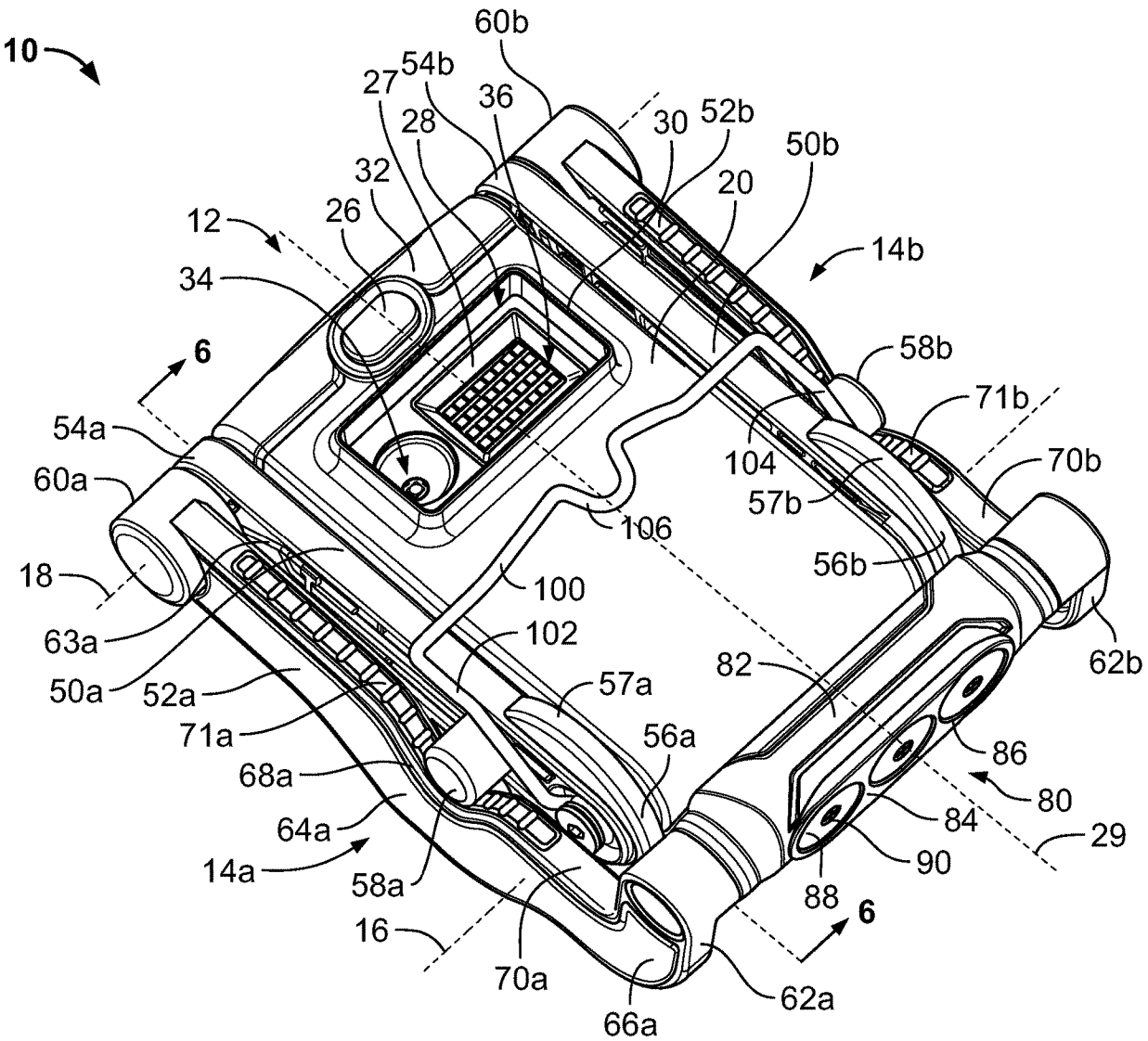
FIG. 1 is a front perspective view of a portable lighting device according to the present disclosure, in an unclamped position.

In one respect, the inventive concept is a lighting device comprising a light head comprising at least one light; a clamping assembly, the light head being rotatably attached to the clamping assembly about a first axis of rotation, the clamping assembly comprising at least one arm assembly, the at least one arm assembly comprising a pivot arm and a clamping arm that are rotatably attached together about a second axis of rotation at respective first ends thereof, each of the pivot arm and the clamping arm having a respective second end located distal from its respective first end, wherein the second ends of each of the pivot arm and the clamping arm are biased towards each other.

In another respect, the inventive concept is a lighting device comprising: a light head comprising at least one light; an arm assembly coupled to the light head, the arm assembly comprising a pivot arm rotatably coupled to a clamping arm about respective first ends thereof, a second end of the pivot arm being spaced apart from the first end thereof and a second end of the clamping arm being spaced apart from the first end thereof, and at least one biasing member connected between the pivot arm and the clamping arm, wherein the arm assembly is configured to allow for the second ends of the pivot arm and the clamping arm to be temporarily separated, thereby defining a gap between the second ends thereof, the at least one biasing member acting to bias the second ends of the pivot arm and the clamping arm together to thereby close the gap.

In yet another respect, the inventive concept is a lighting device comprising: a light head comprising at least one light; and a clamping assembly, the clamping assembly comprising a first arm assembly and a second arm assembly, each of the first and second arm assemblies comprising a first arm member having a first end and a second end, a second arm member having a first end and a second end, and a spring connected between the first arm member and the second arm member, wherein in each of the first and second arm assemblies the respective first arm member and the respective second arm member are rotatably attached together at the respective first ends thereof and the spring acts to bias the respective second ends of the first arm member and the second arm member towards each other.

DETAILED DESCRIPTION

The ensuing detailed description provides exemplary embodiment(s) only, and is not intended to limit the scope, applicability, or configuration of the herein disclosed embodiment(s). Rather, the ensuing detailed description of the exemplary embodiment(s) will provide those skilled in the art with an enabling description for implementing the exemplary embodiments in accordance with the present disclosure. It should be understood that various changes may be made in the function and arrangement of elements without departing from the spirit and scope of the invention, as set forth in the appended claims.

To aid in describing the disclosure and/or invention as claimed, directional terms may be used in the specification and claims to describe portions of the present disclosure and/or invention (e.g., upper, lower, left, right, etc.). These directional definitions are merely intended to assist in describing the embodiment(s) and claiming the invention, and are not intended to limit the disclosure or claimed invention in any way. In addition, reference numerals that are introduced in the specification in association with a drawing figure may be repeated in one or more subsequent figures without additional description in the specification, in order to provide context for other features.

It should be understood that when an element is referred to as being "connected" or "coupled" to another element, it can be integral with the other element, directly connected or coupled to the other element, or that intervening elements may be present. In contrast, when an element is referred to as being "directly connected" or "directly coupled" to another element, it should be understood that no intervening elements are present. Other words used to describe the relationship between elements should be interpreted in a like fashion (e.g., "between" versus "directly between," "adjacent" versus "directly adjacent," etc.).

For purposes of the attached specification and claims, the term "approximately parallel" means within a range of plus or minus 5 degrees from parallel, inclusive of an exact parallel arrangement.

For purposes of the attached specification and claims, the term "approximately perpendicular" means within a range of plus or minus 5 degrees from perpendicular, inclusive of an exact perpendicular arrangement.

In applications in which it is desirable or necessary to have a portable light that can be secured to a wide variety of structures, for example a table, a door, a car hood, etc., a portable light with an adjustable light head that is capable of being clamped, hooked, and/or magnetically attached to the foregoing exemplary structures may be an effective tool. It may also be desirable to have a tool that is extremely low-profile when not in use, thus maximizing its storability—for example in a drawer, a tool box, or carry-bag—when not in use. It is the desire of Applicant to disclose a portable lighting device that incorporates several improvements over the prior art.

Figure 2:
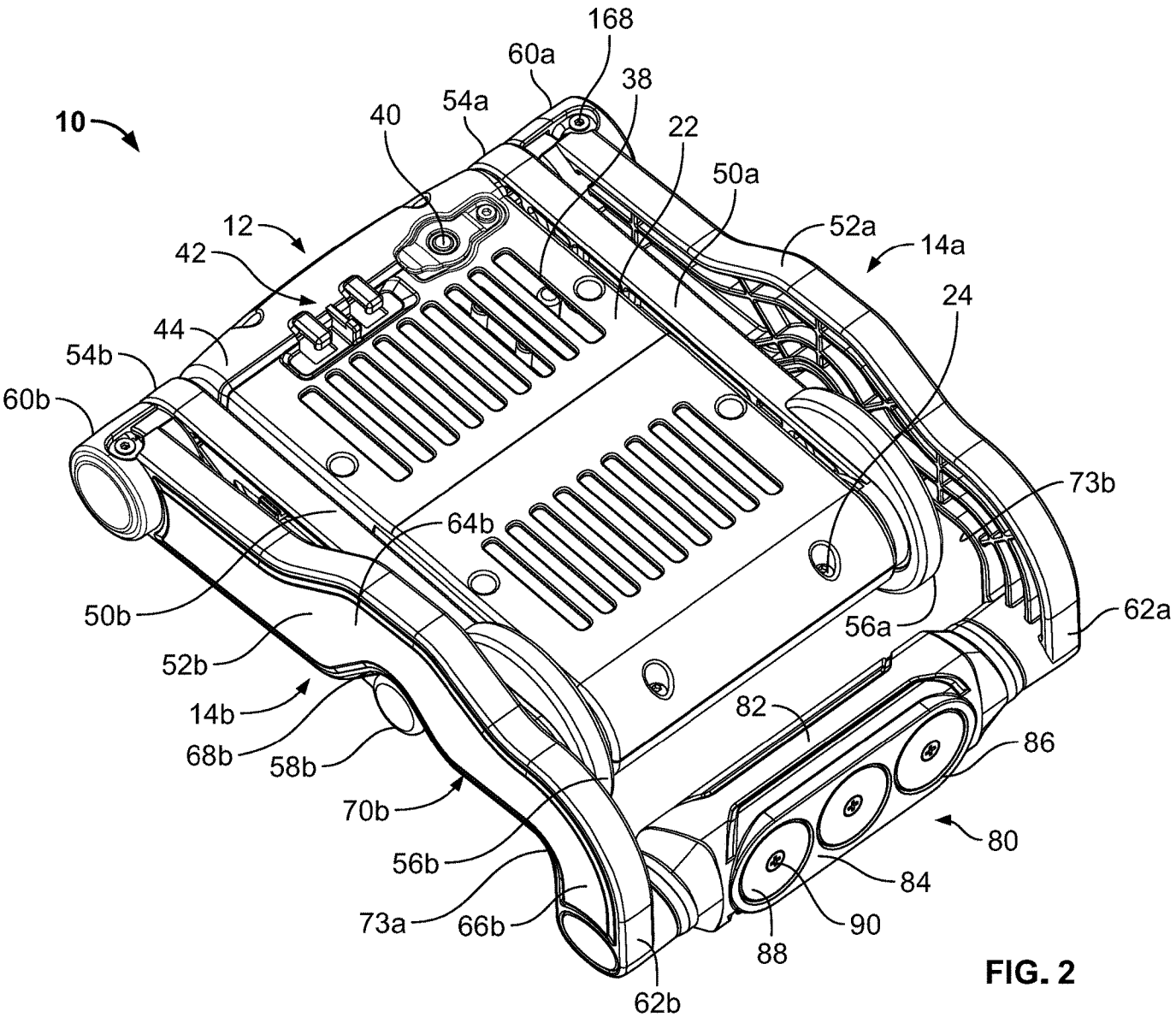
FIG. 2 is a rear perspective view of the portable lighting device of FIG. 1.

Referring now generally to FIGS. 1 and 2, a portable lighting solution in the form of a lighting device 10 according to the present disclosure will be described in detail. In this embodiment, the lighting device 10 includes a light head 12 that is rotatably attached to a clamping assembly 13 about a first axis of rotation 16. In the illustrated non-limiting example, the light head 12 is rotatably coupled to a pair of arm assemblies 14*a*,14*b* arranged adjacent to lateral sides of the light head 12 (e.g., left and right sides from the perspective of FIG. 1). In the present embodiment, as will be described below in further detail, the arm assemblies 14*a*, 14*b*—along with a crossbar 80 that attaches between the arm assemblies 14*a*,14*b*—form the general structure of the clamping assembly 13.

In this embodiment, the light head 12 includes a front cover 20 and a back cover 22 that are attached together via multiple fasteners 24 (for ease of illustration, only a single fastener 24 is labeled in the Figures). In the illustrated non-limiting example, an on/off switch 26 extends through the front cover 20 and is configured to control operation of a first light 34 and a second light 36, which are located within a light opening 28 and behind a lens cover 27 in the front cover 20, and the second light 36 is a multi-LED array in the form of a rectangular grid that can act as a flood light. In this embodiment, the on/off switch 26 can be used to turn either of the first light 34 or second light 36 on or off, switch between operation of the first light 34 or second light 36, or change the light output intensity of the first light 34 or second light 36. In alternative embodiments according to the present disclosure, multiple separate switches may be provided to accomplish these functions, the on/off switch(es) may be located elsewhere on the lighting device 10, and/or a different type, quantity, and/or configuration of lights may be located on the light head 12. The internal parts, assembly, and functionality of the light head 12 are otherwise outside the scope of the present specification, and will not be described further.

In this embodiment, the front cover 20 includes a shroud 30 protruding outward from the surface of the front cover 20 (see FIG. 3) and surrounding the periphery of the light opening 28. The shroud 30 can shield a user's eyes from the bright light emitted by the first and/or second light 34,36 as the user is looking at the light head 12 from the peripheral edges thereof (e.g., the sides, top, or bottom of the light head 12, from the perspective of FIG. 1). In alternative embodiments, the shroud 30 may be omitted.

In the illustrated non-limiting example, the back cover 22 includes multiple vents 38 (for ease of illustration, only one vent 38 is labeled) that allow airflow to and from the internal parts of the light head 12 thereof. A charging port 40 located on the back cover 22 is connected in electrical communication with various circuitry and one or more batteries enclosed within the front cover 20 and the back cover 22. The back cover 22 also includes a wire clip 42 adjacent to the charging port 40 that can be used to secure a wire to the back cover 22 when the wire (and plug attached thereto, e.g., for an A/C adapter) are inserted into the charging port 40. As will be described in greater detail in the paragraphs to follow, the light head 12 also includes mounts 119*a*,119*b* for securing a pivot hinge assembly 130 to either side thereof (see FIG. 7), which is used to rotatably attach the light head 12 to the arm assemblies 14*a*,14*b* such that the light head 12 can be selectively rotated and held in a plurality of rotated positions.

With continued reference to FIGS. 1-2, the arm assemblies 14*a*,14*b* according to the present disclosure that are secured to either side of the light head 12 will be described in detail. Generally, the arm assemblies 14*a*,14*b* are symmetric (i.e., mirror images) about a longitudinal axis 29 defined by the light head 12 (i.e., an axis generally passing through the centers of the on/off switch 26 and crossbar 80). As such, the symmetric components herein are designated by an "a" or "b" following their respective reference numeral. However, unless necessary to articulate the functionality of the components and for ease of drafting the specification, only the left side components, denoted by "a", will be discussed in the paragraphs to follow. It is therefore to be understood by one of ordinary skill in the art that the components sharing the same reference number but marked by "b" provide the same functionality, or are of the same form (albeit, symmetric), as their "a"-marked counterparts. Further, the components described herein may be referred to or described using the terms "longitudinally" or "laterally." It is to be understood that these terms are used with reference to the aforementioned longitudinal axis 29. For example, the use of the phrase "extending longitudinally" can refer a member that extends approximately parallel to the longitudinal axis 29. Similarly, the use of the phrase "extending laterally outward/inward" refer to a member that extends generally perpendicular to the longitudinal axis 29.

Figure 3:
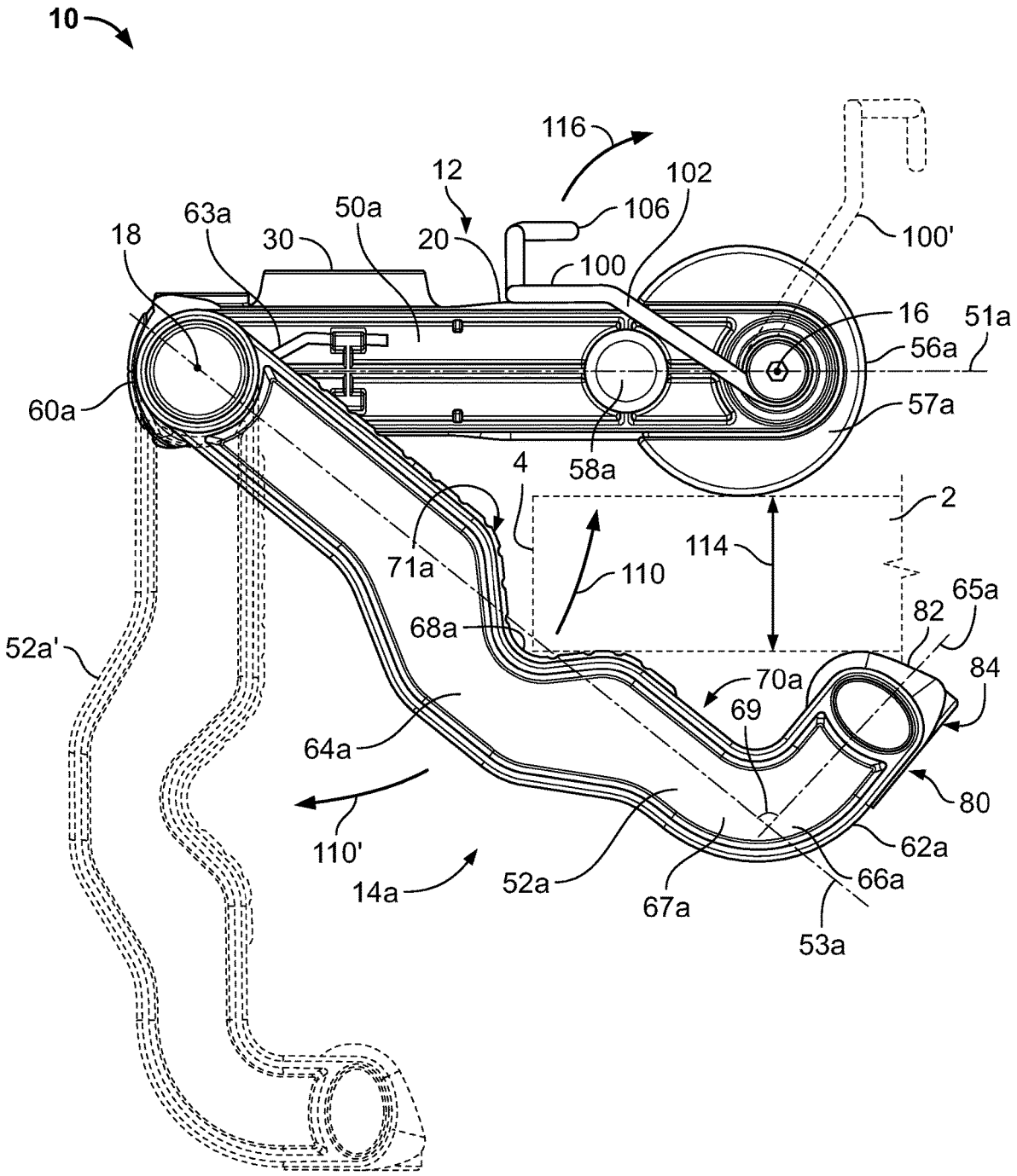
FIG. 3 is a side view of the portable lighting device of FIG. 1, in a clamped position and showing alternate positions of portions thereof.

In this embodiment, the arm assembly 14*a* includes a pivot arm 50*a* (i.e., a first arm member) that is pivotably attached to a clamping arm 52*a* (i.e., a second arm member) about a second axis of rotation 18, and the arm assembly 14*b* includes a pivot arm 50*b* (i.e., a first arm member) that is pivotably attached to a clamping arm 52*b* (i.e., a second arm member) about the second axis of rotation 18. In the illustrated non-limiting example, the first and second axes of rotation 16,18 are parallel to each other, but spaced apart in a non-linear (i.e., spatially offset or non-aligned) configuration, although alternative embodiments of the lighting device are envisioned in which these two axes of rotation are aligned along a single axis. In the example illustrated in FIGS. 1-2, the first axis of rotation 16 and the second axis of rotation 18 are separated by a distance approximately defined by a length of the pivot arm 50*a*. In this embodiment, the pivot arm 50*a* is a generally elongate member arranged adjacent to a lateral side of the light head 12 and includes a first end 54*a* that is located adjacent to the top side of the light head 12 (when the light head 12 is in its folded or non-rotated configuration as shown in FIGS. 1-3) and a second end 56*a* located opposite the first end 54*a*. The pivot arm 50*a* has a longitudinal axis 51*a*. In the illustrated non-limiting example, the light head 12 is rotatably coupled to the second ends 56*a*,56*b* of the pivot arms 50*a*,50*b* about the axis of rotation 16, and the clamping arms 52*a*,52*b* are pivotably coupled to the first ends 54*a*,54*b* of the pivot arms 50*a*,50*b*. The coupling between the light head 12 and the pivot arms 50*a*,50*b*, as well as the coupling between the pivot arm 50*a* and the clamping arm 52*a*, will be described below in detail with reference to FIGS. 6-8.

In this embodiment, the pivot arm 50*a* includes a bumper 57*a* and a peg 58*a*. The bumper 57*a* protrudes radially outwardly from the second end 56*a* of the pivot arm 50*a* (with respect to the first axis of rotation 16). In the illustrated non-limiting example, the bumper 57*a* is a disc-shaped member that at least partially surrounds the second end 56*a* of the pivot arm 50*a*. The peg 58*a* is positioned between the first end 54*a* and the second end 56*a* of the pivot arm 50*a* and protrudes laterally outwardly from the pivot arm 50*a* to align and be engageable with an indented portion 58*a* of the clamping arm 52*a*. In the illustrated non-limiting example, the peg 58*a* has a generally cylindrical shape (i.e., a circular shape of generally uniform radius in cross-section). In alternative embodiments, the peg 58*a* can have a shape that is non-circular in cross-section and/or could have a contoured, knurled, or textured surface.

In this embodiment, the clamping arm 52*a* is a generally elongate member arranged adjacent to the pivot arm 50*a* and includes a first end 60*a* adjacent to the first end 54*a* of the pivot arm 50*a* and a second end 62*a* opposite the first end 60*a*. The clamping arm 52*a* has a longitudinal axis 53*a*. As will be described in greater detail below, the clamping arm 52*a* is biased towards the pivot arm 50*a* with a spring 63*a* that is coupled between the first ends 54*a*,60*a* of the pivot arm 50*a* and the clamping arm 52*a*, respectively. The clamping arm 52*a* also includes an intermediate portion 64*a* and a portion 66*a*. The intermediate portion 64*a* is positioned between the first end 60*a* and the second end 62*a* and defines an indent 68*a* located along an upper surface 70*a* of the clamping arm 52*a* (from the perspective of FIG. 1). The indent 68*a* extends into the body of the clamping arm 52*a* in a concave manner and is complementarily shaped to receive the peg 58*a* when the arm assembly 14*a* is in a clamped position, as in FIG. 1. In this embodiment, the indent 68*a* defines a "corner-like" interior surface that is comprised of two straight portions separated by an approximately 90 degree bend (see side view of FIG. 3), though different shapes, sizes, and angles for the indent 68*a* are possible in alternative embodiments according to the present disclosure. In the present embodiment, the portion 66*a* is positioned at the second end 62*a* of the clamping arm 52*a* and attached to the intermediate portion 64*a* by a bend 67*a*. In this embodiment, the portion 66*a* is relatively short, comprises a longitudinal axis 65*a*, and is angled approximately perpendicularly to the main body of the clamping arm 52*a*, as illustrated by angle 69 (see FIG. 3), to define an interior bend surface 73*a*. In alternative embodiments of the lighting device 10 according to the present disclosure, the portion 66*a* may be of different lengths and/or be angled at different angles from the intermediate portion 64*a*. In further alternative embodiments, the locations of the peg 58*a* and the indent 68*a* could be reversed, with the peg 58*a* extending from the clamping arm 52*a* and the indent located in the pivot arm 50*a*.

Still referring to FIGS. 1-2, the lighting device 10 includes the crossbar 80 coupled between the second ends 62*a*,62*b* of the clamping arms 52*a*,52*b*. This enables each of the arm assemblies 14*a*,14*b* to pivot together about the axis of rotation 18 such that an angle between pivot arm 50*a* and clamping arm 52*a* is similar or identical to an angle between pivot arm 50*b* and clamping arm 52*b* at all times during adjustability of the arm assemblies 14*a*,14*b*. In this embodiment the crossbar 80 has a varying thickness and non-identical profile along the length of the crossbar 80, but in alternative embodiments may have a standard thickness and profile across its length. In the present embodiment, the crossbar 80 includes a gripping portion 82 (i.e., grip) that defines a thick and ergonomic shape that can, for example, enable the crossbar 80 to also be used as a carrying handle. In this embodiment, the thickness of the crossbar 80 reduces (e.g., tapers) at lateral ends thereof to meet the second ends 62*a*,62*b* of the clamping arms 52*a*,52*b*. The crossbar 80 also includes an outwardly-facing surface 84 (from the perspective of FIG. 1) that, in this embodiment, houses one or more magnets 88. In the illustrated non-limiting example, the crossbar 80 includes one or more magnet apertures 86 extending into the surface 84. A magnet, e.g., magnet 88, is received within each of the magnet apertures 86 and secured therein using a fastener 90 (for ease of illustration, only a single magnet aperture 86, magnet 88, and fastener 90 are labeled in the Figures). The one or more magnets 88 provided in the crossbar 80 enable the lighting device 10 to be magnetically attached to metal surfaces or structures (e.g., a car hood or metal frame), which enhances the usability and functionality of the lighting device 10 for use in a myriad of environments to provide lighting for a user. Further, as shown in its unclamped configuration in FIGS. 1 and 2, the lighting device 10 has a very low profile (i.e., a compact height dimension when viewed from the front, back, or sides), allowing it to be easily stored—for example in a drawer or portable toolbox—when not in use. In some embodiments, the lighting device 10 may have a maximum height dimension (not labeled) of no more than 4.00 inches (10.16 cm), no more than 3.50 inches (8.89 cm), or no more than 3.00 inches (7.62 cm), when in its unclamped configuration as shown in FIGS. 1 and 2. It should be understood that even more low-profile versions of the lighting device 10 are also possible within the scope of the present disclosure.

Referring now to FIGS. 1-3, the lighting device 10 also includes a handle 100 that is pivotably coupled at respective ends thereof between the second ends 56*a*,56*b* of the pivot arms 50*a*,50*b* along the first axis of rotation 16. Since the arm assemblies 14*a*,14*b* are biased into their unclamped position by default, as shown in FIGS. 1 and 2, it may be difficult for the user to move the pivot arms 50*a*,50*b* away from the clamping arms 52*a*,52*b* while making an attempt to clamp the lighting device 10 to a surface or object without means to simultaneously separate the pivot arms 50*a*,50*b* from the clamping arms 52*a*,52*b* with one hand. The handle 100 is thus used to provide leverage for a user when attempting to open the arm assemblies 14*a*,14*b* of the lighting device 10. In the illustrated non-limiting example, the handle 100 is formed from a length of metal wire of circular cross-sectional shape that has been bent into a shape that permits for a user's hand to be placed behind the handle 100 even when it is fully rotated against the light head 12 or pivot arms 50*a*,50*b*. The handle 100 spans laterally across the front of the light head 12 and has a first arm 102 and a second arm 104 extending therefrom that meet and attach to the second ends 56*a*,56*b* of the pivot arms 50*a*,50*b* via, for example, a fastener on each end (see fastener 132 in FIG. 7). In the illustrated non-limiting example, the handle 100 can rest on the surface of the front cover 20 when not in use (see FIG. 3). Alternatively or additionally, the first and second arms 102,104 can rest on the pegs 58*a*,58*b* when the handle 100 is not in use. In the illustrated non-limiting example, the handle 100 can include a "U-shaped" or looped portion 106 that provides a raised section of the handle 100 such that a gap is made between the surface of the front cover 20 and the looped portion 106 (see FIG. 3). The gap made by the looped portion 106 can, for example, allow one or more finger(s) of a user to be placed underneath the handle 100 such that the handle 100 can be pivoted about the first axis of rotation 16 and away from the light head 12, as shown by arrow 116 and handle 100' (illustrated in broken lines in FIG. 3 to show an alternate position of the handle 100). As further discussed below, the looped portion 106 can also be used to hook the lighting device 10 from various structures.

With the structural details of the lighting device 10 having been described, the function of the light head 12 and the arm assemblies 14*a*,14*b* of the clamping assembly 13 will now be described with reference to FIGS. 3-5. The lighting device 10 is movable between an unclamped position (FIGS. 1, 2, and 5) and a plurality of various clamped positions (see, e.g., FIGS. 3-4) by rotation of the clamping assembly 13 about the second axis of rotation 18, as shown by arrows 110,110' and clamping arm 52*a*' (illustrated in broken lines in FIG. 3 to show an alternate position of the clamping arm 52*a*). In this embodiment, in the unclamped position, the clamping arms 52*a*,52*b* are approximately parallel with the pivot arms 50*a*,50*b*. In addition, the pegs 58*a*,58*b* act as a rotational stop for the clamping arms 52*a*,52*b*. For example, in the unclamped position, the peg 58*a* is received within the indent 68*a* along the upper surface 70*a* of the clamping arm 52*a*. Due to the springs 63*a*,63*b* biasing the clamping arms 52*a*,52*b* towards the pivot arms 50*a*,50*b*, the pegs 58*a*,58*b* prevent the clamping arms 52*a*,52*b* from rotating past the unclamped position (i.e., rotating past the unclamped position in the counter-clockwise direction illustrated by arrow 110). While in some embodiments and configurations of the lighting device 10 the rotational axes of the joints of the two arm assemblies 14*a*,14*b*—i.e., where the first end 54*a* of the pivot arm 50*a* rotatably connects with the first end 60*a* of the clamping arm 52*a* and where the first end 54*b* of the pivot arm 50*b* rotatably connects with the first end 60*b* of the clamping arm 52*b*—will tend to align along a single linear axis (i.e., the second axis of rotation 18), on occasion this may not occur, such that the rotational axes of these two joints are not perfectly aligned. When this occurs, the rotational axis of the joint of the arm assembly 14*a* can be said to align along the second axis of rotation, and the rotational axis of the joint of the arm assembly 14*b* can be said to align along a third axis of rotation.

In the clamped position, the clamping arms 52*a*,52*b* can be rotated to a range of positions between approximately parallel with the pivot arms 50*a*,50*b* and approximately perpendicular with the pivot arms 50*a*,50*b* (e.g., the rotational position of clamping arm 52*a*' in FIG. 3), depending on the size and shape of the structure 2,2' the lighting device 10 is to be clamped on. For example, with specific reference to FIG. 3, the lighting device 10 can be clamped on a structure 2, which in the illustrated non-limiting example is rectangular in shape (e.g., representative of being clamped on a door, wall, desk, table, frame, etc.) However, one of ordinary skill in the art would readily recognize that the lighting device 10 could be clamped on any regular or irregular shape (e.g., a pipe, a car hood, a structure having a non-uniform cross section, a tree branch, etc.). In the example illustrated in FIG. 3, the clamping arm 52*a* can be pivoted away from the pivot arm 50*a* (e.g., in the clockwise direction illustrated by arrow 110'). The pivoting of the clamping arm 52*a* away from the pivot arm 50*a* defines a gap 114 measured between the bottom portion of the bumper 57*a* and the top portion of the crossbar 80 (i.e., from the perspective of FIG. 3). Once the gap 114 is of sufficient size to accommodate placement of the structure 2 within the gap 114, the lighting device 10 may be placed around the structure 2. Due to the clamping arms 52*a*,52*b* being biased towards the pivot arms 50*a*,50*b* by the springs 63*a*,63*b* coupled therebetween, the restorative force provided by the springs 63*a*,63*b* provides a clamping force onto the structure 2 that securely clamps the lighting device 10 to the structure 2.

In the illustrated non-limiting example, the structure 2 may extend far enough into the gap 114 such that an end portion 4 of the structure 2 extends into the concave indent 68*a*. In the configuration illustrated in FIG. 3, the concave shape of the indent 68*a* can allow the structure 2 to extend therein such that there may be multiple points of contact between the lighting device 10 and the structure 2. For example, one point of contact could be between at least one of the bumpers 57*a*,57*b* and the structure 2, another point of contact could be between at least a portion of the crossbar 80 or grip 82 and the structure 2, and yet another point of contact could be between at least a portion of the upper surfaces 70*a*,70*b* of the clamping arms 52*a*,52*b* (e.g., within one of the indents 68*a*,68*b* along the intermediate portions 64*a*,64*b* of the clamping arms 52*a*,52*b*) and the structure 2. Further, if an end portion 4 of the structure 2 has a rectangular shape, like the example illustrated in FIG. 3, the shape of the structure 2 may mate neatly with the complementary shape of the indent 68*a*, creating a tight fit that minimizes or prevents shifting or wobble.

In the illustrated non-limiting example, the clamping arms 52*a*,52*b* each have a strip 71*a*,71*b* attached to the upper surface 70*a*,70*b* thereof. This may, for example, enhance the grip of the arm assemblies 14*a*,14*b* onto the object. In some non-limiting examples, the strips 71*a*,71*b* comprise a "rubberized" or "rubber-like" material, and may be made from a thermoplastic elastomer, thermoplastic rubber, rubber, or any other "rubber-like" or other material than enhances the grip (i.e., friction) between the lighting device 10 and a structure 2. In the illustrated non-limiting example, the grip 82 and bumpers 57*a*,57*b* may also comprise, or be coated with, these "rubberized" materials such that all surfaces that form a potential point of contact between the structure and the lighting device 10 can more effectively grip the structure 2,2'.

Figure 4:
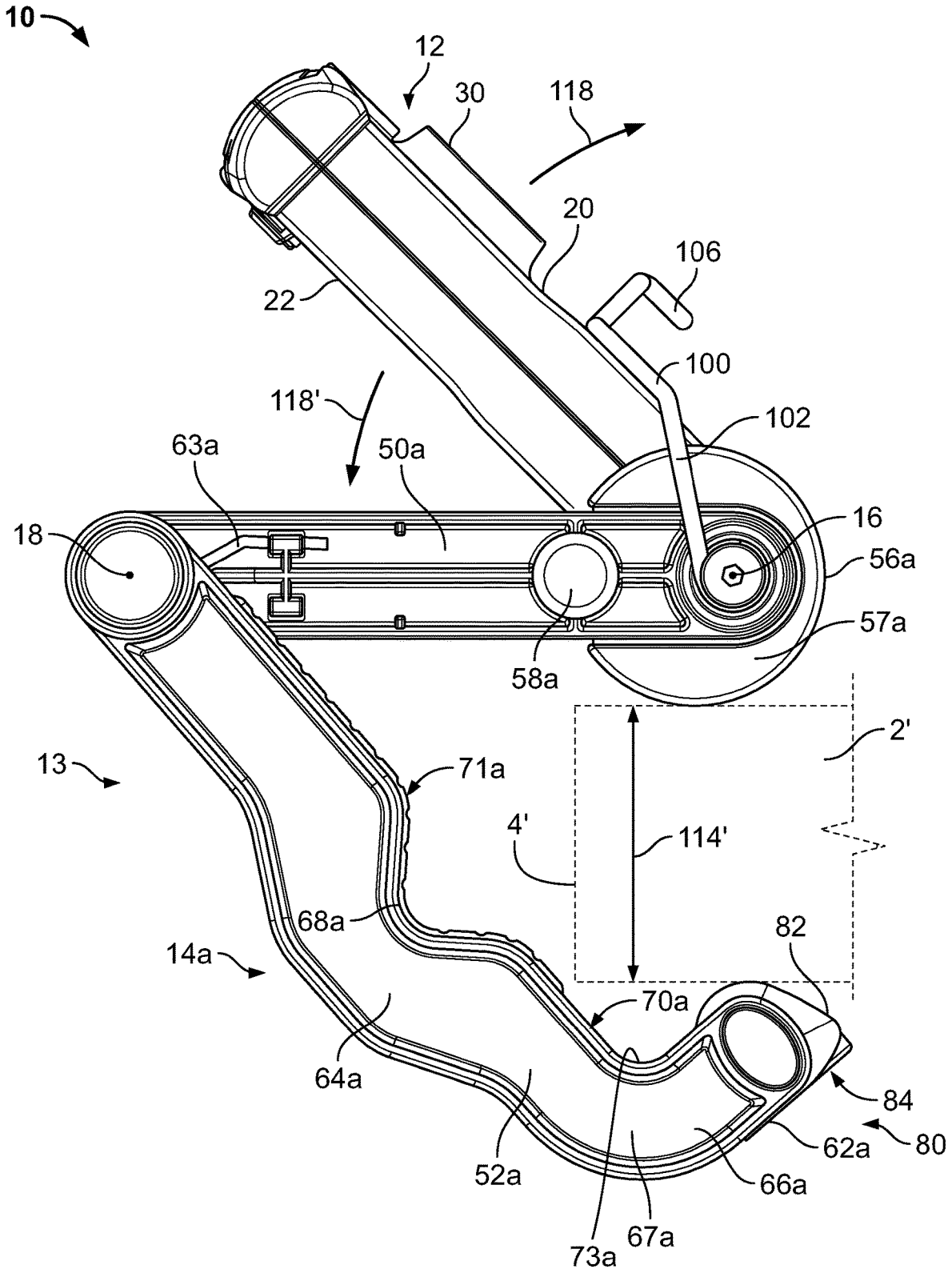
FIG. 4 is a side view of the portable lighting device of FIG. 1, in a clamped position and showing an alternate position of a light head thereof.
Figure 5:
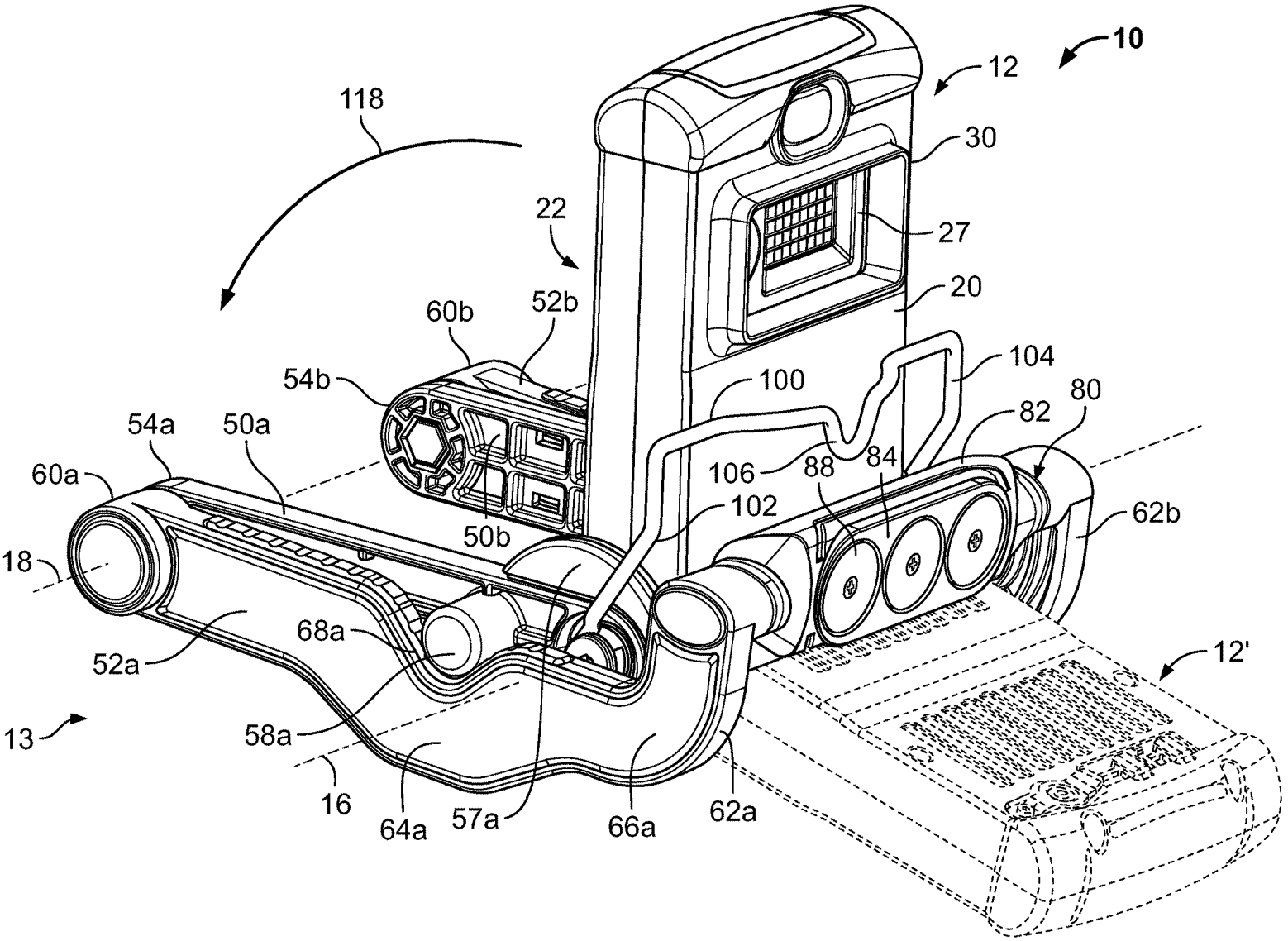
FIG. 5 is a front perspective view of the portable lighting device of FIG. 1, in the unclamped position and with the light head in an alternate position.

Referring now to FIG. 4, the lighting device 10 is now shown clamped onto a structure 2' having a greater thickness than the structure 2 illustrated in FIG. 3. In the illustrated non-limiting example, the pivoting of the clamping arm 52*a* defines a gap 114' between the bottom portion of the bumper 57*a* and the top portion of the crossbar 80 (i.e., from the perspective of FIG. 4) such that the lighting device 10 may be clamped onto the structure 2'. In this embodiment, the points of contact between the structure 2' and the upper surfaces 70*a*,70*b* of the clamping arms 52*a*,52*b* will be different, but the structure 2' will engage the bumpers 57*a*,57*b* and crossbar 80 in a similar fashion to how the structure 2 of FIG. 3 engages with these parts.

Figure 9:
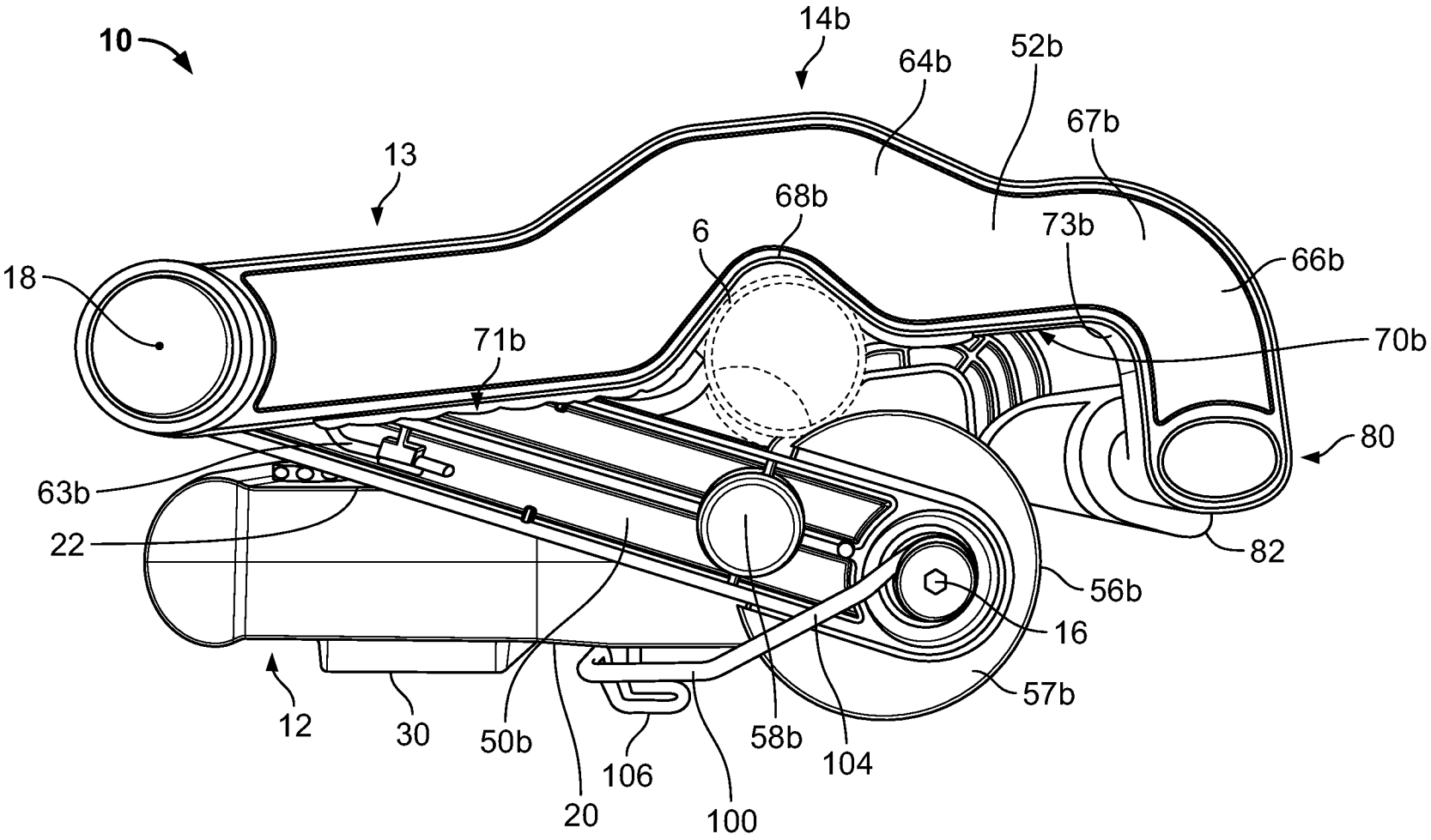
FIG. 9 is a side perspective view of the portable lighting device of FIG. 1, in a clamped position.

Referring now to FIG. 9, the lighting device 10 is shown in an alternative clamped configuration, i.e., around a cylindrical structure 6 (e.g., a pipe). In this clamped configuration, significant portions of the structure 6 can sit within the indents 68*b*,68*a* in the clamping arms 52*b*,52*a*, with the structure 6 making contact with each of the indents 68*b*,68*a* in more than one location. In addition, a portion of each of the bumpers 52*b*,52*a* presses against opposing respective portions of the structure 6 such that the lighting device 10 is firmly supported from the structure 6. It should be understood that other external structures having rounded portions or edges may sit all or partially within the indents 68*b*,68*a*, thus allowing for the lighting device 10 to be stably mounted thereto.

Figure 10:
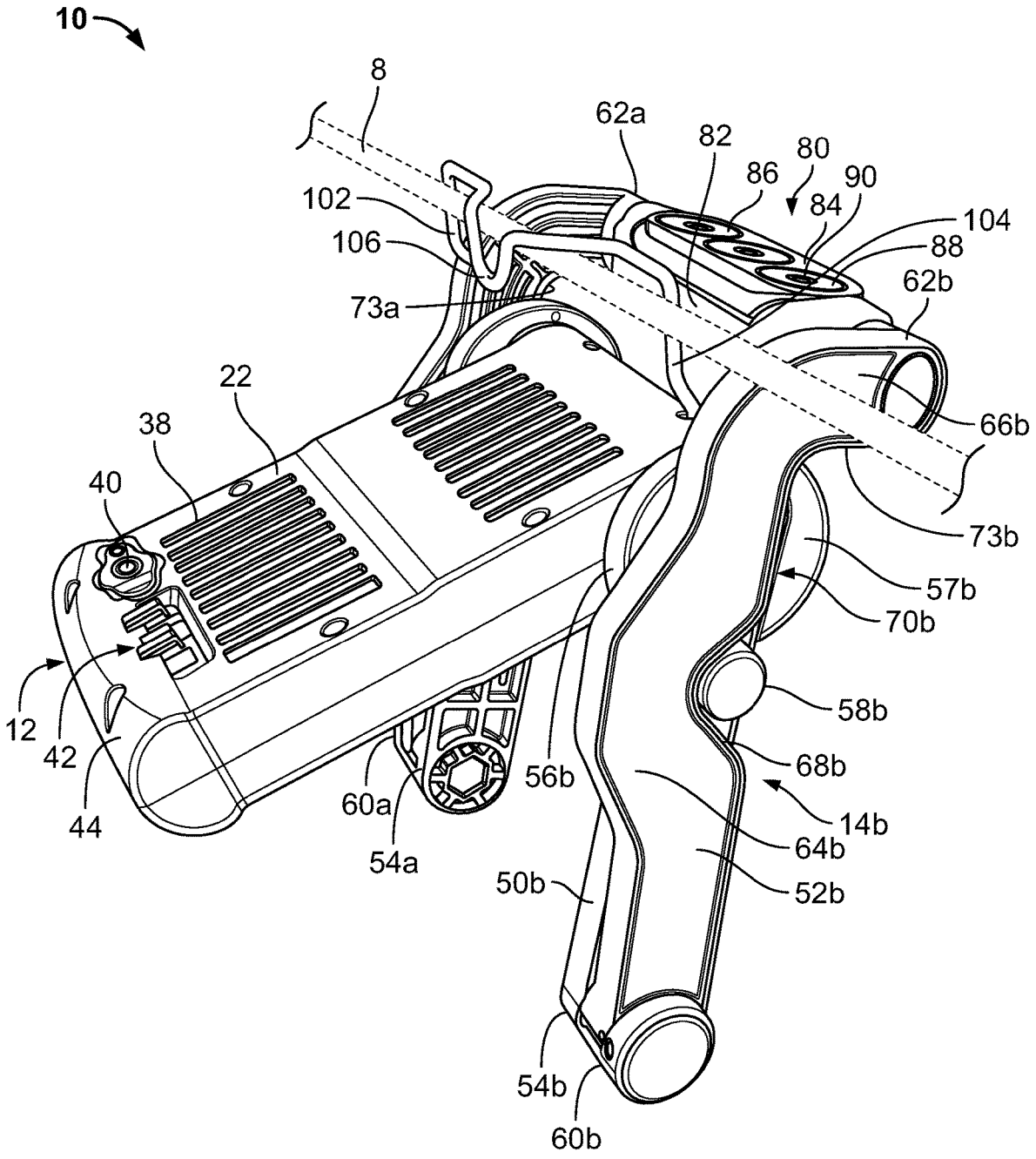
FIG. 10 is a side perspective view of the portable lighting device of FIG. 1, in an alternative mounted position.

Referring now to FIG. 10, the lighting device 10 is shown in an alternative mounted position in which the handle 100 has been rotated to the opposite side of the light head 12 (i.e., to the side of the back cover 22) and used—via the looped portion 106—as a hook so that the lighting device 10 is mountable from a structure 8 (e.g., a pipe, a tree branch, or a rope). In this configuration the lighting device 10 could be said to be "unclamped," and yet the lighting device 10 is supportable from an exterior structure via the handle 100.

As illustrated in FIGS. 4, 5, 9, and 10, the light head 12 can be rotated about the first axis of rotation 16 while the lighting device 10 is in either the clamped or unclamped position. For example, with specific reference to FIG. 4, the light head 12 can be rotated about the first axis of rotation 16 in either the clockwise direction (as shown by arrow 118) or the counter-clockwise direction (as shown by arrow 118'). As will be described herein, the coupling between the light head 12 and the pivot arms 50*a*,50*b* enables the light head 12 to rotate unhindered, unless an object in the path of rotation (i.e., in the path of either of the arrows 118,118') blocks the light head 12. For example, the light head 12 can be rotated clockwise until the light head 12 contacts either a portion of the structure 2' that the lighting device 10 is clamped to (see FIG. 4) or else makes contact with a portion of the cross-bar 80 (see FIG. 5). Alternatively, the lighting device can be rotated counter-clockwise, through the gap between the pivot arms 50*a*,50*b*, until the light head 12 contacts either an end portion 4' of the structure 2' or else makes contact with a portion of the cross-bar 80 (see the position of the light head 12' illustrated by broken lines in FIG. 5). As illustrated in FIGS. 4, 5, 9, and 10, unless there is an object or structure in the rotational path of the light head 12, the light head 12 can be rotated 360° about the first axis of rotation 16. As would be understood by a person having ordinary skill in the art, the lighting device 10 may also be used in the configuration shown in FIG. 5, in which the clamping assembly 13 freely rests on a surface, with the light head being amiable at the target that the user would like to illuminate.

Figure 6:
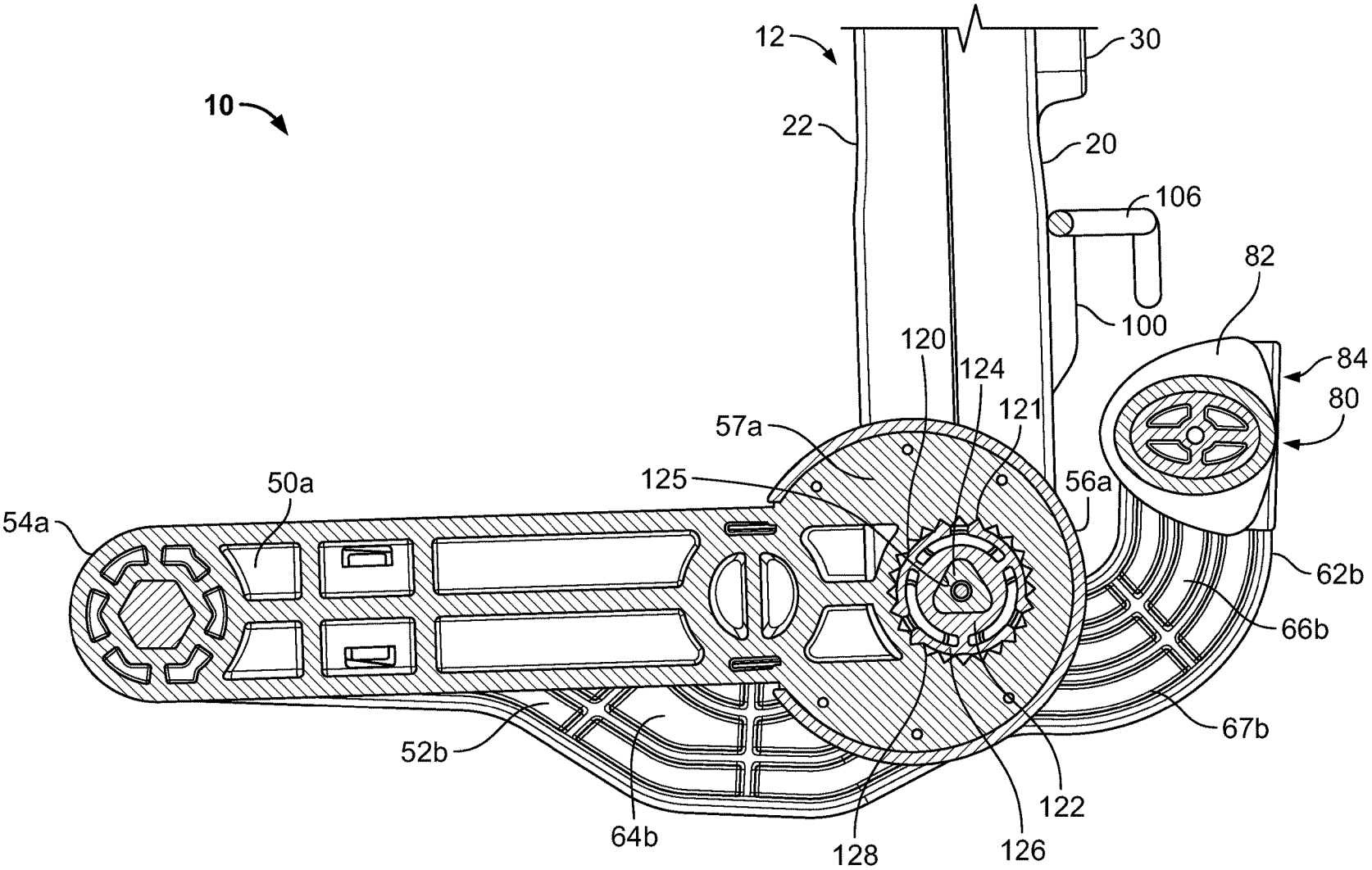
FIG. 6 is a cross-sectional view of the portable lighting device, in the positions shown in FIG. 5, taken along line 6-6 of FIG. 1.

Referring now to FIG. 6, a cross-sectional view of a pivot hinge assembly 130 that is located within the second end 56*a* of the pivot arm 50*a*, as taken along line 6-6 (see FIG. 1), is illustrated. The pivot hinge assembly 130 enables the light head 12 to be selectively rotated between a plurality of positions about the first axis of rotation 16. The pivot hinge assembly 130 includes a gear bracket 122 received within an internal gear 120 that is recessed in the second end 56*a* of the pivot arm 50*a*. The gear bracket 122 is coupled to and rotationally locked with the light head 12 at the mounts 119*a*,119*b* located on either side thereof. The mount 119*a* includes a protrusion 124 extending laterally outward from the side of the light head 12. In this embodiment, the protrusion 124 has an approximately triangular shape in cross section, but in alternative embodiments may have any non-circular cross-sectional shape to prevent its rotation with respect to the gear bracket 122. The gear bracket 122 includes a complementarily-shaped aperture 125 at the center thereof to receive and engage with the protrusion 124. In the illustrated non-limiting example, the protrusion 124 and aperture 125 are in the form of a triangle with rounded points. The non-circularity of the protrusion 124 and the aperture 125 result in a rotational locking between the light head 12 and the gear bracket 122.

In this embodiment, the gear bracket 122 includes a plurality of circumferentially extending arms 126 with gear teeth 128 located along exterior sides thereof (for ease of illustration, only a single arm 126 and gear tooth 128 are labeled in the Figures). During rotation of the light head 12, and thereby the gear bracket 122, the arms 126 deflect radially inwards as the gear teeth 128 transition from one tooth 121 towards an adjacent tooth on the internal gear 120, and then snap back radially outwards as the gear teeth 128 engage the adjacent tooth on the internal gear 120. The pivot hinge assembly 130 thus attaches the light head 12 to the pivot arms 50*a*,50*b* in a "ratcheting" fashion, so that the light head 12 is moveable between a plurality of discrete positions but is also held in place in the selected position via the pivot hinge assembly 130 unless the light head 12 is pressed or pulled with a sufficient force to move it out of the selected rotational position.

Figure 7:
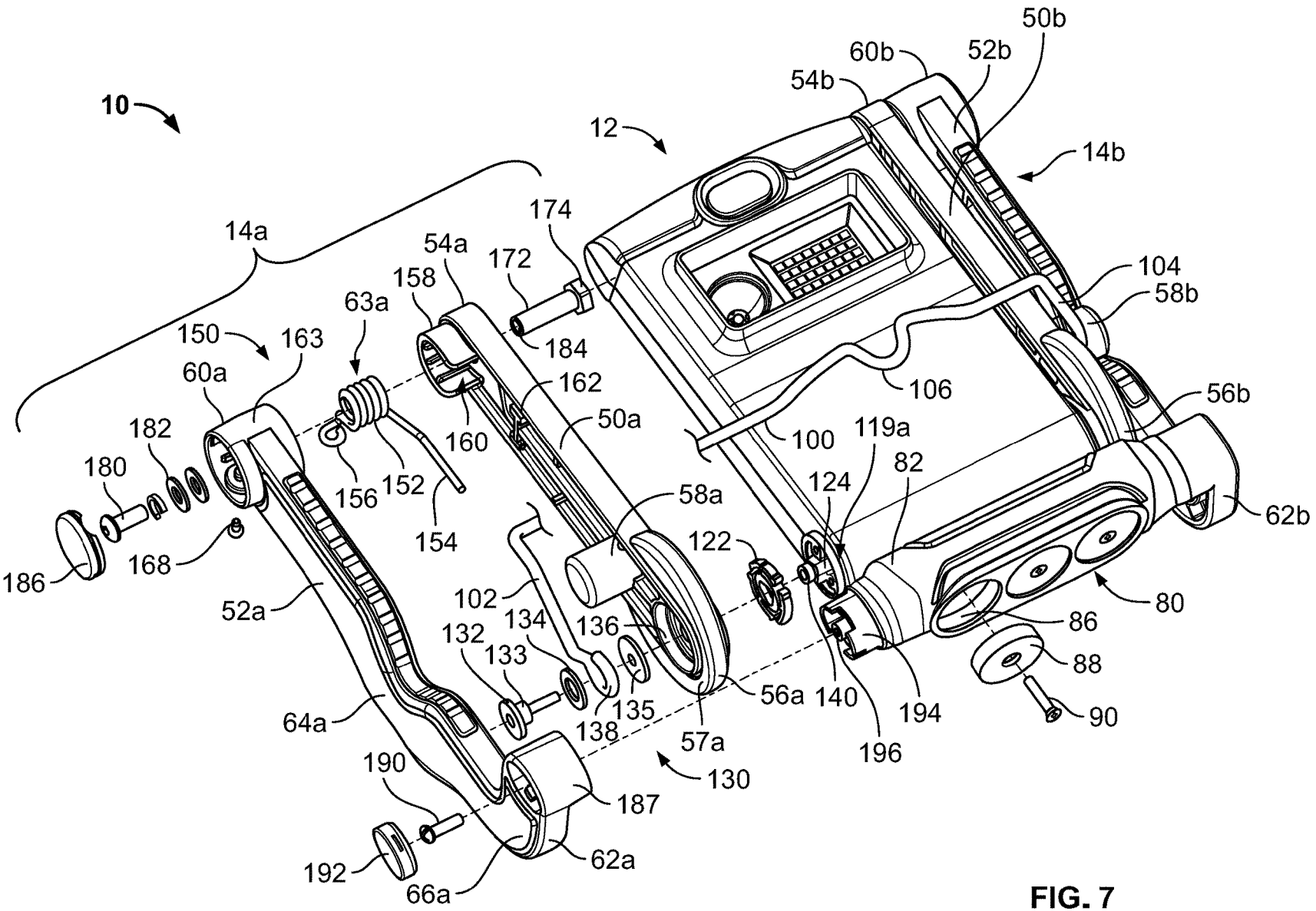
FIG. 7 is a partial exploded of the portable lighting device of FIG. 1.
Figure 8:
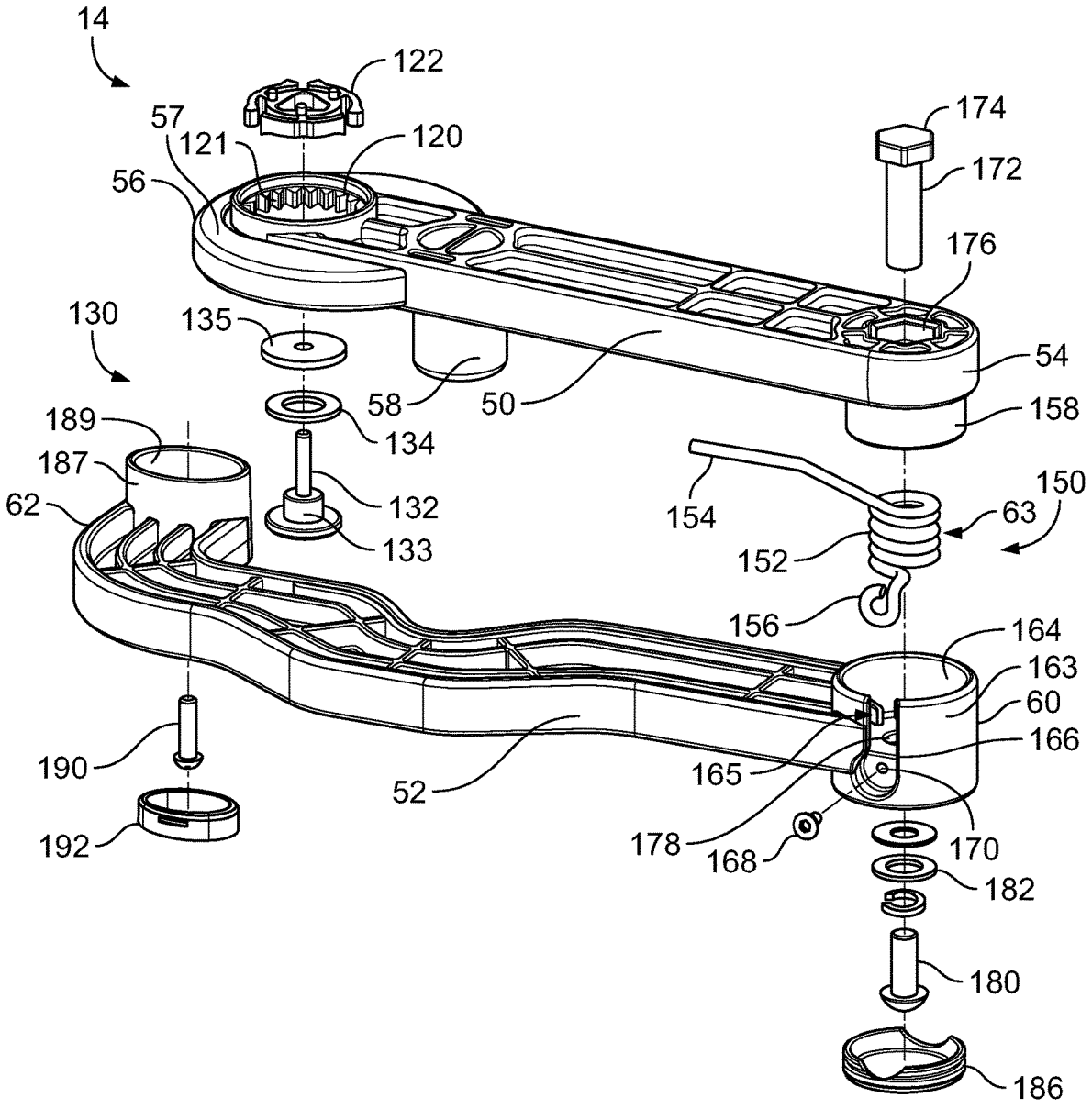
FIG. 8 is an exploded view of an arm assembly of the portable lighting device of FIG. 1.

Referring now to FIGS. 7-8, the coupling between the light head 12 and the pivot arms 50*a*,50*b* will be described in detail. When the pivot hinge assembly 130 is assembled, the gear bracket 122 is placed in the recess formed by the internal gear 120 on the pivot arm 50*a*. Next, the pivot arm 50*a* is attached to the light head 12 by placing the gear bracket 122 and pivot arm 50*a* assembly onto the mount 119*a* such that the protrusion 124 is received in an aperture 125 on the gear bracket 122. Then, a looped end 138 located at an end of the arm 102 of the handle 100 is positioned in a recess 136 formed on an outside surface of the second end 56*a* of the pivot arm 50*a*. In the illustrated non-limiting example, a fastener 132 is inserted through a compressible washer 134, looped end 138, a rigid washer 135, and pivot arm 50*a* to secure the pivot hinge assembly 130—including the pivot arm 50*a* and the handle 100—to the light head 12 (i.e., via the fastener 132 being threaded into an internally threaded aperture 140 on the light head 12). The fastener 132 includes a shoulder portion 133 that presses and clamps the rigid washer 135 against the outer surface of the threaded aperture 140. Further, the shoulder portion 133 of the fastener 132 is dimensioned to fit within the looped end 138 of the handle 100 while slightly compressing the compressible washer 134 against the outer surface of the looped end 138 of the handle 100, thus preventing the handle 100 from rotating freely. In some non-limiting examples the compressible washer 134 is comprised of a thermoplastic elastomer (TPE), thermoplastic polyurethane (TPU), or rubber material, and the rigid washer is comprises of stainless steel, though other suitable materials are possible for one or both types of washer. In some non-limiting examples, compressible washers 134 are positioned on either side of the looped end 138 of the handle 100. It should be noted that the arm 102 of the handle 100 is shown separated from the remainder of the handle 100 via the illustrated wavy break lines such that the exploded arrangement of the handle 100 in the pivot hinge assembly 130 can be illustrated.

Referring still to FIGS. 7-8, a clamp hinge assembly 150 of the arm assembly 14*a* will be described in detail. As best illustrated in FIG. 7, in this embodiment the first end 54*a* of the pivot arm 50*a* includes a "C"-shaped protrusion 158 extending laterally outward therefrom, the C-shaped protrusion 158 defining an opening 160 facing towards the second end 56*a* of the pivot arm 50*a*. The pivot arm 50*a* also includes a spring retainer clip 162 in the form of an "L"-shaped protrusion extending from the outside-facing surface of the pivot arm 50*a* adjacent to the opening 160 in the "C"-shaped protrusion 158. As best illustrated in FIG. 8, the first end 60*a* of the clamping arm 52*a* includes a generally cylindrically-shaped first end piece 163 with a cylindrical bore 164 formed therein. The first end piece 163 of the clamping arm 52*a* also includes a "J"-shaped recess 166 formed into the bottom side of the first end piece 163 (from the perspective of FIG. 7), thereby forming an opening 165 between an interior of the cylindrical bore 164 and the "J"-shaped recess 166.

In the illustrated non-limiting example, the spring 63*a* is received within the "C"-shaped protrusion 158 of the pivot arm 50*a* and the first end piece 163 of the clamping arm 52*a*. The spring 63*a* can be any form of a biasing element or extension and retraction device that is configured to bias the clamping arm 52*a* towards the pivot arm 50*a*, however, in the illustrated non-limiting example the spring 63*a* is a torsion spring. One of ordinary skill in the art would readily recognize that other forms of biasing elements can be used herein, and it should be understood that the torsion spring shown herein is but one example of such a configuration. In alternative embodiments, the biasing member could be any type of extension and retraction device, including but not limited to different types of coiled springs, leaf or laminated springs, plate springs, or gas cylinders.

In this embodiment, the spring 63*a* includes a coiled portion 152 with a first end 154 and a second end 156 extending therefrom. In the illustrated non-limiting example, the first end 154 is in the form of an elongated, relatively straight arm extending away from the coiled portion 152 such that, when installed into the pivot arm 50*a*, the first end 154 extends through the opening 160 in the "C"-shaped protrusion 158 and secured by the spring retainer clip 162. In the illustrated non-limiting example, the second end 156 is in the form of a loop such that, when installed into the clamping arm 52*a*, the second end 156 extends through the opening 165 and the looped end is received within the "J"-shaped recess 166 and secured therein with a fastener 168. For example, the fastener 168 is inserted through the second end 156 (i.e., the looped end) and threaded into a threaded aperture 170 located at the base of the "J"-shaped recess 166.

Referring still to FIGS. 7-8, the coupling between the pivot arms 50*a*,50*b* and the clamping arms 52*a*,52*b* will be described in further detail. When assembled, a hinge pin 172 having a hexagonally shaped head 174 is inserted through an aperture 178 in the first end 54*a* of the pivot arm 50*a* to be received and secured in a complementarily shaped hexagonal recess 176 formed in an interior surface of the pivot arm 50*a*, thereby rotationally locking the hinge pin 172 with the pivot arm 50*a*. Next, the coiled portion 152 of the spring 63*a* is inserted onto the shaft of the hinge pin 172 and the first end 154 of the spring 63*a* is clipped into the spring retainer clip 162 to secure the spring 63*a* to the pivot arm 50*a*. Then, the first end piece 163 of the clamping arm 52*a* can be placed over the "C"-shaped protrusion 158 on the pivot arm 50*a* such that the "C"-shaped protrusion 158 is received within the cylindrical bore 164 and the hinge pin 172 is received within an aperture 178 formed in the base of the cylindrical bore 164. Next, the fastener 168 is inserted into the second end 156 of the spring 63*a* to secure the spring 63*a* to the clamping arm 52*a*. Then, a fastener 180 is inserted through the first end piece 163 from an exterior surface of the clamping arm and threaded into an internally threaded aperture 184 formed in the hinge pin 172 to secure the clamp hinge assembly 150, including the clamping arm 52*a* and pivot arm 50*a*, together. In the illustrated non-limiting example, one or more washers 182 are positioned between the fastener 180 and the first end piece 163 of the clamping arm 52*a*. Lastly, an end cap 186 is inserted into the first end piece 163 to cover the fastener 180 received therein.

With continued reference to FIGS. 7-8, the coupling between the crossbar 80 and the second ends 62*a*,62*b* of the clamping arms 52*a*,52*b* will be explained in detail. In the illustrated non-limiting example, the second end 62*a* of the clamping arm 52*a* includes a generally oval-shaped cylindrical second end piece 187. The second end piece 187 includes a bore 189 formed therein, which in this embodiment is of generally oval cross-sectional shape. In the illustrated non-limiting example, the crossbar 80 includes a complementarily-shaped protrusion 194 located at an end thereof. The protrusion 194 is sized and shaped such that the protrusion 194 is received into the cylindrical bore 189 of the second end piece 187. When assembled, a fastener 190 is inserted through the second end piece 187 and threaded into an aperture 196 located in the end of the crossbar 80, thereby securing the crossbar 80 to the clamping arm 52*a*.

Referring again generally to FIGS. 1-10, many components of the lighting device 10 may include an internal ribbing or ribbed structure to enhance the strength characteristics of the components of the lighting device 10 while reducing material weight and cost, as is known in the art. For example, as best illustrated in FIGS. 7-8, the clamping arms 52*a*,52*b* and the pivot arms 50*a*,50*b* include several ribs located on interior and/or exterior surface thereof. In addition, several other components of the lighting device 10 can include a "rubberized" or "rubber-like" material or coating, for example but not limited to a TPE or TPU material. For example, in addition to the strips 71*a*,71*b*, the grip 82, and bumpers 57*a*,57*b*, outwardly facing surfaces of the clamping arms 52*a*,52*b* and caps 32,44 attached to a top end of the front and back covers 20,22 of the light head 12 (from the perspective of FIGS. 1-2) may also comprise, or be coated with, these "rubberized" materials. These surfaces with the rubberized coating can enhance the users grip on the lighting device 10, as well as protect the lighting device 10 from damage or wear during use. These rubberized materials may also improve the ability of the lighting device 10 to stay clamped onto exterior objects, owing to the enhanced coefficient of friction of rubberized materials as compared to smoother materials (e.g., non-textured plastics).

Although exemplary implementations of the herein described systems and methods have been described in detail above, those skilled in the art will readily appreciate that many additional modifications are possible in the exemplary embodiments without materially departing from the novel teachings and advantages of the herein described systems and methods. Accordingly, these and all such modifications are intended to be included within the scope of the herein described systems and methods. The herein described systems and methods may be better defined by the following exemplary claims.

What is claimed is:

1. A lighting device comprising:

a light head comprising at least one light;

a clamping assembly, the light head being rotatably attached to the clamping assembly about a first axis of rotation, the clamping assembly comprising at least one arm assembly, the at least one arm assembly comprising a pivot arm and a clamping arm that are rotatably attached together about a second axis of rotation at respective first ends thereof, each of the pivot arm and the clamping arm having a respective second end located distal from its respective first end, wherein the second ends of each of the pivot arm and the clamping arm are biased towards each other.

2. The lighting device of claim 1, wherein the first axis of rotation and the second axis of rotation are not aligned.

3. The lighting device of claim 1, further comprising a spring attached between the pivot arm and the clamping arm.

4. The lighting device of claim 1, the at least one arm assembly of the clamping assembly comprising a first arm assembly, the pivot arm being a first pivot arm and the clamping arm being a first clamping arm, the clamping assembly further comprising a second arm assembly comprising a second pivot arm and a second clamping arm that are rotatably attached together about a third axis of rotation at respective first ends thereof, each of the second pivot arm and the second clamping arm having a respective second end located distal from its respective first end, wherein the second ends of each of the second pivot arm and the second clamping arm are biased towards each other.

5. The lighting device of claim 4, wherein the first axis of rotation and the second axis of rotation are not aligned.

6. The lighting device of claim 5, wherein the second axis of rotation and the third axis of rotation are aligned.

7. The lighting device of claim 4, further comprising a crossbar attached between the second end of the first clamping arm and the second end of the second clamping arm.

8. The lighting device of claim 7, the crossbar comprising at least one magnet.

9. The lighting device of claim 4, further comprising a first spring attached between the first pivot arm and the first clamping arm and a second spring attached between the second pivot arm and the second clamping arm.

10. The lighting device of claim 4, further comprising a peg extending from one of the first pivot arm and the first clamping arm and an indent located in the other of the first pivot arm and the first clamping arm, the peg and the indent being of approximately complementary shapes so that the peg rests at least partially within the indent in a default position of the first arm assembly.

11. The lighting device of claim 10, wherein the peg extends from the first pivot arm and the indent is located in the first clamping arm.

12. The lighting device of claim 10, wherein when the first arm assembly is in its default position, a longitudinal axis of the first clamping arm is parallel with a longitudinal axis of the first pivot arm.

13. A lighting device comprising:

a light head comprising at least one light;

an arm assembly coupled to the light head, the arm assembly comprising a pivot arm rotatably coupled to a clamping arm about respective first ends thereof, a second end of the pivot arm being spaced apart from the first end thereof and a second end of the clamping arm being spaced apart from the first end thereof, and at least one biasing member connected between the pivot arm and the clamping arm, wherein the arm assembly is configured to allow for the second ends of the pivot arm and the clamping arm to be temporarily separated, thereby defining a gap between the second ends thereof, the at least one biasing member acting to bias the second ends of the pivot arm and the clamping arm together to thereby close the gap.

14. The lighting device of claim 13, wherein the light head is rotatably coupled to the arm assembly about a first axis of rotation.

15. The lighting device of claim 14, wherein the pivot arm is rotatably coupled to the clamping arm about a second axis of rotation which is not aligned with the first axis of rotation.

16. The lighting device of claim 13, wherein the at least one biasing member is at least one torsion spring.

17. A lighting device comprising:

a light head comprising at least one light; and a clamping assembly, the clamping assembly comprising a first arm assembly and a second arm assembly, each of the first and second arm assemblies comprising a first arm member having a first end and a second end, a second arm member having a first end and a second end, and a spring connected between the first arm member and the second arm member, wherein in each of the first and second arm assemblies the respective first arm member and the respective second arm member are rotatably attached together at the respective first ends thereof and the spring acts to bias the respective second ends of the first arm member and the second arm member towards each other.

18. The lighting device of claim 17, the light head being rotatably attached to the clamping assembly about a first axis of rotation.

19. The lighting device of claim 18, wherein the first arm member is rotatably coupled to the second arm member about a second axis of rotation which is not aligned with the first axis of rotation.

20. The lighting device of claim 17, the clamping assembly further comprising a crossbar attached between the first arm assembly and the second arm assembly.

* * * * *